United States Patent [19]

Sebastien et al.

[11] Patent Number: 4,804,337

[45] Date of Patent: Feb. 14, 1989

[54] ELECTRICAL CONNECTORS

[75] Inventors: Leslie Sebastien, Cote St. Luc; Andre Jelwan; Gaetan Dube, both of Montreal, all of Canada

[73] Assignee: Northern Telecom Limited, Montreal, Canada

[21] Appl. No.: 112,321

[22] Filed: Oct. 23, 1987

[51] Int. Cl.[4] ..... H01R 13/58

[52] U.S. Cl. ..... 439/449; 174/138 F

[58] Field of Search ..... 174/138 F; 439/449, 439/460, 470, 367, 445, 892

[56] References Cited

U.S. PATENT DOCUMENTS 3,278,674 10/1966 Matthysse et al. ..... 174/138 F
3,838,213 9/1974 Georgopulos et al. ..... 174/138 FX

FOREIGN PATENT DOCUMENTS 2358234 6/1974 Fed. Rep. of Germany ..... 439/460
2939413 4/1981 Fed. Rep. of Germany ..... 439/449

*Primary Examiner*—Eugene R. LaRoche
*Assistant Examiner*—Steven J. Mottola
*Attorney, Agent, or Firm*—R. J. Austin

[57] ABSTRACT

A one-piece cover for covering open parts of passageways on two opposite sides of an electrical connector housing. The cover has two hinged cover portions for folding the cover around the housing. Each cover portion has projections for engagement within closed parts of the passageways and is also resiliently flexible to enable the cover portion to be flexed into position with apertures in the cover portion receiving extensions of walls of the housing which define the open parts of the passageways.

19 Claims, 5 Drawing Sheets

ELECTRICAL CONNECTORS

This invention relates to electrical connectors.

Electrical connectors are known having a plurality of terminals for mass termination of electrical conductors and in which individually electrically isolated terminal mating ends for electrical connection to other electrical devices or apparatus are accessible from or extend from mating end faces of the connectors. Such connectors conveniently may house the conductors in a high density configuration to provide terminal mating ends also in a high density thereby enabling the mating end faces of the connectors to have minimal area and dimensions. Connections with such minimal dimensions at the mating end faces and which have other outside dimensions suitably minimized are particularly useful for connection to electrical apparatus which, because of space limitations, also has closely packed terminal mating portions.

An electrical connector having the above-discussed size attributes is one in which, when viewed directly onto the mating end face, no part of the connector extends beyond or substantially beyond the boundaries of the end face. In such a case, the connector may be closely packed together with other and similar connectors when electrically connected at a connecting plane to other electrical apparatus thereby enabling the size of the connecting plane also to be minimized.

An electrical connector which provides the above advantages is described in U.S. Pat. No. 4,243,288 entitled "Connector Assembly for Mass Termination" and granted Jan. 6, 1981 in the names of J. E. Lucius and L. T. Ritchie. This prior connector has a housing formed with a plurality of terminal passages which open at the mating end face of the housing, are enclosed on all sides for a distance from the mating end face and are outwardly open at a location spaced from that end. The outwardly open regions of the passageways provide access to insulation displacement means of the terminals to enable incoming conductors to be connected to individual terminals. In this connector structure, the passageways are arranged in two banks with the open regions of the banks of passageways facing in opposite directions from opposite side surfaces of the connector. Two covers are arranged against the side surfaces to cover the open regions. The covers lie substantially wholly within the confines of the boundary of the mating end face of the connector. A problem with this design is that the covers are interconnected together at the rear of the covers, i.e. at the end of the housing remote from the mating end face. The latching arrangement between the two covers is necessarily extremely small and would involve difficult molding procedures.

In a copending patent application Ser. No. 068,304 filed July 1, 1987, (Canadian Application No. 541,158, filed July 2, 1987), entitled "Electrical Connectors" in the name of R. Blakely et al, there is described a connector having two separate covers which are applied to the two opposite sides of the connector housing without being connected together. This arrangement avoids the need for using the latches described in U.S. Pat. No. 4,243,288, but the covers in the Blakely application may accidentally be removed because the holding forces for retaining the covers in position may not be as high as could be desired.

The present invention seeks to provide a connector which overcomes or minimizes the above disadvantages.

Accordingly, the present invention provides an integral one-piece cover of insulating material for covering the open sides of open-sided parts of two banks of passageways on opposite sides of an electrical connector housing, the open sides facing in opposite directions from one bank to the other, the cover comprising two generally planar cover portions for closing the open sides of the open-sided passageway parts, the cover portions hingedly movable towards and away from one another along a hinged edge of each cover portion with each cover portion extending from its hinged edge to a free edge, the hinging movement being into and out of positions in which the cover portions face one another, and in which:- each cover portion is resiliently flexible, is formed along its free edge with spaced apart projections for engagement within closed-sided passageway parts of the housing, and between its edges is formed with apertures spaced apart in a direction parallel to its edges for receiving extensions of passageway defining walls of the housing; and with the cover portions facing one another, the cover provides an opening for passage of a cable between the cover portions.

With the above arrangement according to the invention, the one-piece cover is easily applied to the two sides of a connector and the interconnection between the cover portions assists in holding the cover portions in position with the integrity of the cover portions avoiding the use of separate covers which need to be interconnected together.

In a preferred structure, the cover is provided with a spine portion which is disposed intermediate the two cover portions and remote edges of the spine portion are connected to the hinged edges of the cover portions.

In an alternative structure, the spine portion is omitted and the cover portions are directly hingedly connected together at their hinged edges. With this arrangement it is necessary for the cover portions to be flexible towards their hinged edges to assist in the application of the cover to the connector housing.

According to a further aspect of the invention there is provided an electrical connector comprising a housing and cover of insulating material in which:- the housing is formed with two planar banks of passageways on two opposite sides of the housing, the passageways extending from a mating end face to a remote end of the housing and formed with open-sided passageway parts which extend from the remote end of the housing, the open sides of the open-sided passageway parts facing in opposite directions from the housing from one bank to the other, the passageways also formed with closed-sided parts extending from the open-sided parts to the mating end face of the housing; the housing has walls separating the passageways of each bank with the walls of the banks of passageways having localized extensions which are spaced both from the closed-sided passageway parts and from the remote end of the housing to locally increase the height of the walls along the open-sided channel parts; and the cover is an integral one-piece structure with two generally planar cover portions hingedly movable towards and away from one another along a hinged edge of each cover portion with each cover portion extending from its hinged edge to a free edge, the hinging movement being into and out of positions in which the cover portions face one another, and in which:- each cover portion is resiliently flexible, is formed along its free edge with spaced apart projections for engagement within closed-sided passageway parts of the housing and between its edges is formed with apertures spaced apart in a direction parallel to its edges for receiving the localized extensions of the walls of the housing; and with the cover portions facing one another, the cover provides an opening for passage of a cable between the cover portions; the cover mountable upon the housing by covering the open sides of one bank of passageways with one cover portion, the projections of which are located within the closed-sided parts of said one bank of passageways and the apertures of which receive the localized extensions of the walls of said one bank of passageways, and with the cover extending around the remote end of the housing, hingedly moving the other cover portion towards the open sides of the other bank of passageways while resiliently flexing the other cover portion to position its projections into the open sides of the other bank of passageways, and then causing the other cover portion to return to its unflexed state while sliding its projections into the associated closed-sided passageway parts and moving its apertures around the extensions on the associated walls of the other bank of passageways.

The invention further includes a method of securing a cover onto an electrical connector housing comprising providing an integral one-piece cover comprising two generally planar and resiliently flexible cover portions hingedly movable towards and away from one another along a hinged edge of each cover portion with each cover portion extending from its hinged edge to a free edge; locating one cover portion in position to close the open sides of open-sided passageway parts of one of two planar banks of passageways which extend along opposite sides of the housing from a mating end face to a remote end of the housing with the open-sided passageway parts disposed towards the remote end and closed-sided passageway parts disposed towards the mating end face of the housing, the one cover portion located in position with projections formed along the free edge of the cover portion extending into the closed-sided passageway parts of said one bank of passageways and apertures formed in the one cover portion disposed around extensions of passageway defining walls of the housing; and then, with the cover extending around the remote end of the housing and with the other cover portion facing the open sides of the other planar bank of passageways, locating the other cover portion in position to close the open sides of the open-sided parts of the other bank of passageways by:- (a) resiliently flexing the other cover portion to dispose projections along its free edge through the open sides of said other bank of passageways; and then (b) returning the other cover portion towards its unflexed state while sliding its projections into the corresponding closed-sided passageway parts and simultaneously moving a flexed apertured region of the other cover portion towards the associated open-sided passageway parts to dispose apertures in said region around extensions of passageway defining walls of the housing.

Embodiments of the invention will now be described, by way of example, with reference to the accompanying drawings, in which.

Figure 1:
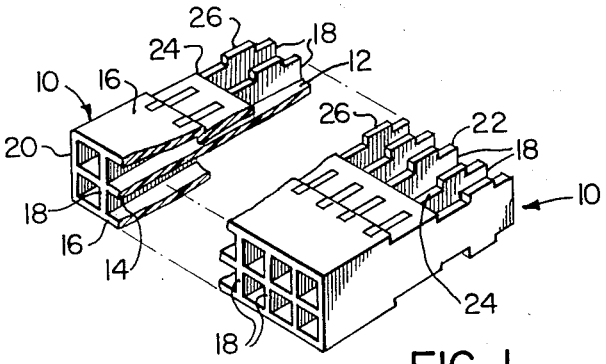
FIG. 1 is an isometric view of a housing forming part of a connector of the first embodiment.

In a first embodiment, shown in FIG. 1, a housing 10 for an electrical connector is integrally formed as a compact substantially flat sided element having a plurality of passageways 12 for accommodating electrical terminals as will be described. The passageways are arranged in two banks vertically spaced apart by a wall 14 which extends between and is spaced from remote sides 16 of the housing. The passageways 12 of each bank are separated by walls 18 which extend laterally from the wall 14 between a mating end face 20 to a remote end 22 of the housing. Each wall 16 extends between the mating end face 20 and an intermediate position 24 towards the remote end. As a result, the walls 16 define closed-sided parts of the passageways 12 extending from the mating end face 20 of the housing and parts of the passageways rearwardly of the walls 16 are open-sided to the remote end 22. Thus the open sides of the passageway parts face in opposite directions from the housing from one bank to the other. The walls 18 between position 24 and the remote end 22 of the housing, i.e. along the open-sided passageway parts, have localized outward extensions 26 which are spaced both from the closed-sided passageway parts and from the remote end of the housing as shown.

Figure 2:
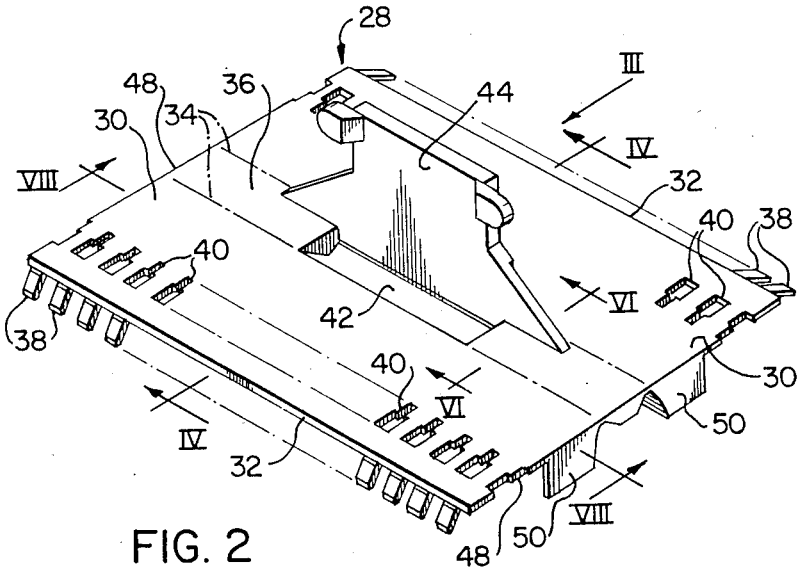
FIG. 2 is an isometric view of a cover for the housing of the connector of the first embodiment and to a larger scale.
Figure 3:
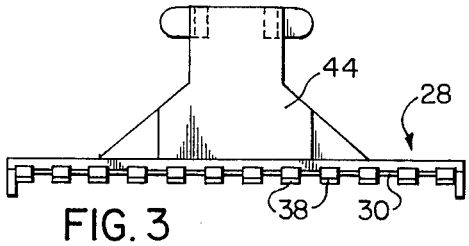
FIG. 3 is a view of the cover of FIG. 2 in the direction of arrow III in FIG. 2.
Figure 4:
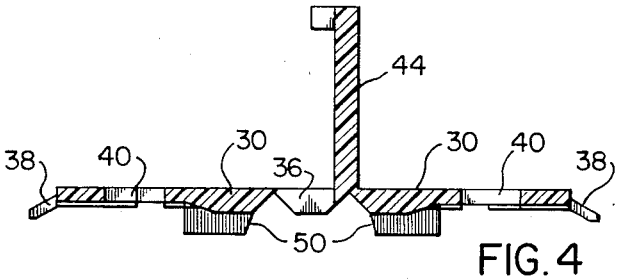
FIG. 4 is a cross-sectional view taken through the cover along line IV—IV in FIG. 2.

FIG. 2 shows an integral one-piece cover 28 according to the first embodiment, this cover being provided for covering open sides of the open-sided parts of the two banks of passageways of the housing as will be described. The cover 28 is formed from any suitable insulating material to provide the required rigidity to the cover when in use and also to enable it to be flexed as required and as will be described. The cover 28 comprises two cover portions 30 each of which extends from a free edge 32 to a hinged edge 34 (indicated by the chain dotted line in FIG. 2). As molded, the cover portions 30 lie in the same plane and the cover also comprises a spine portion 36 which lies between the hinged edges 34. The two cover portions are hingedly movable from the position shown in FIG. 2 into a position in which they face one another as will be described and as may be seen from FIG. 13. Along the free edge of each cover portion, there are provided a plurality of spaced apart projections 38. These projections extend at an angle to the plane of the cover portion so as to be inclined from the free edge towards the projections of the other cover portion when the cover portions face one another. Each cover portion is also formed with apertures 40 which are spaced apart in a direction parallel to its free and hinged edges as shown by FIG. 2. The spacing and size of the projections 38 is such as to enable them to be received within the passageways and between the walls 18 of the housing 10 and the size and spacing of the apertures 40 are such as to slidably receive the extensions 26 of the walls 18.

A rectangular opening 42 is formed in the spine portion 36 for passage of a cable into the connector. As can be seen from FIG. 2, the opening 42 extends the full width of the spine portion between the hinged edges 34.

Figure 5:
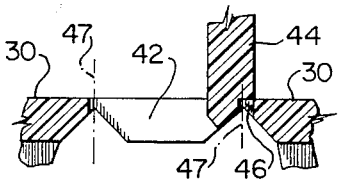
FIGS. 5 and 6 are cross-sectional views through part of the cover taken along lines IV—IV and VI—VI in FIG. 2 and to a much larger scale.
Figure 6:
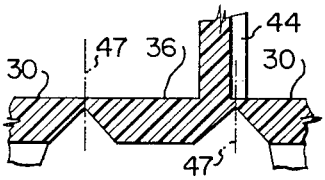
Figure 7:
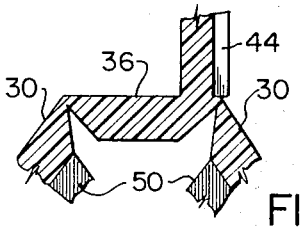
FIG. 7 is a cross-sectional view similar to FIG. 6, but showing the cover in a partially flexed condition.

The cover is also provided with a device for securing the cable to the connector as it emerges from within the connector. This device or paddle 44 is formed integrally with the cover. As can be seen from FIG. 2, the paddle in the molded condition extends substantially normal to the plane of the cover portions. The paddle lies to one side of the opening 42 and overlies one of the hinged edges 34 along the length of the aperture 42 to provide robustness to the structure of the paddle. However, the cover is molded in such a way that during flexing of the cover portions 30 relative to the spine portion 36, the paddle 44 does not move relative to the spine portion 36 but retains its position normal to the spine portion. This is accomplished in molding by providing a longitudinal groove 46 along the length of the opening 42 between the paddle and the adjacent cover portion 30 to ensure that the paddle is completely disconnected from this cover portion across the corresponding hinge line indicated as chain dotted by reference 47 in FIG. 5. The hinge lines coincide with the hinged edges 34 and are provided at weakened sections of the structure. At positions beyond each end of the opening 42 the paddle 44 is thinner, as can be seen from FIGS. 2 and 6, in that it is stepped away from the adjacent cover portion 30 to the other side of the associated hinge line 47 so as not to be influenced by the hinging action of the cover portion upon the spine portion. As a result, and as can be seen from FIG. 7, when the hinge portions are hinged upon the spine portion, the paddle 44 remains in the same position, i.e. normal to the plane of the spine portion to enable a cable emerging from the opening 42 to be secured to the paddle.

The cover portions 30 are sufficiently wide between the hinged and free edges as to extend beyond the remote end of the housing. To cover any gap between the cover portions and rearwardly of the remote end 22 of the housing, each side edge 48 of the cover is provided with a flange structure which extends normal to the general plane of the cover in its molded condition. Each flange structure comprises a flange 50 extending from each cover portion 30. These flanges are shaped so as to coact with the underside (as shown) of spine portion 36 when the cover portions are folded towards each other in the assembled condition so as to close any gap between the cover portions.

Figure 8:
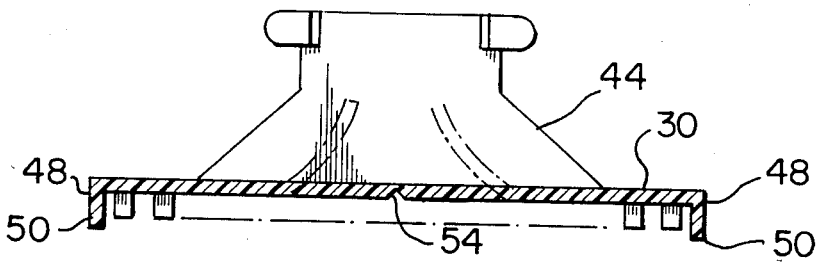
FIG. 8 is a cross-sectional view of the cover taken along line VIII—VIII in FIG. 2.

In addition, one of the cover portions is provided with a weakened section extending from the opening 42 to its free edge 32. This weakened section is provided during molding to provide a rectilinear thinner molded region 54 (see FIG. 8) which extends midway between the two side edges 48.

Figure 9:
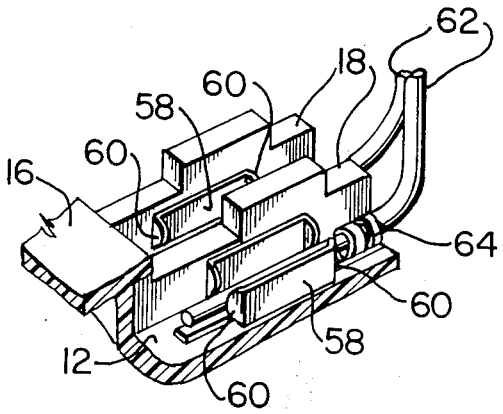
FIG. 9 is a fragmentary isometric view of the housing in the same direction as in FIG. 1 and to a much larger scale, showing the housing with terminals located in passageways of the and with conductors assembled into the housing.

In use, to assemble the connector onto the conductors of a cable, the cable 56 is first passed through the opening 42 before the insulated conductor wires are connected into terminals carried by the housing. These terminals 58 (see FIG. 9) are of known construction and have insulation displacement portions 60 for lateral acceptance of conductors 62 of the cable while displacing the insulation locally from the conductor so as to make an electrical connection between the conductor and the insulation displacement portions. As shown in FIG. 9, the terminals are disposed within the passageways 12 with the insulation displacement portions in the open parts of the passageways to provide accessability for the conductors to be assembled into the terminals. In addition, each terminal includes a strain relief means 64 of known construction and which comprises two tabs which are folded around the insulation of the respective conductor to transmit tensile load between the insulation and the terminal. The other end of each terminal (not shown) is housed within the closed part of its respective passageway and is a pin receptacle of conventional construction for electrical connection to a pin in a baseboard or at a connecting plane of some electrical apparatus with which the connector is to be used. The pin receptacle may be of a structure described in U.S. Pat. No. 4,076,369 granted Feb. 28, 1978 in the name of H. J. Ostopovitch.

Figure 10:
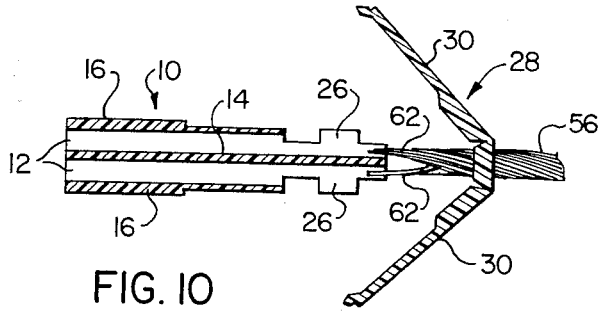
FIGS. 10, 11, 12 and 13 are cross-sectional views in side elevation of the housing and cover showing different stages in the assembly of cover onto the housing.

When the conductors are connected as described above into their respective terminals and the strain relief means have been applied to the insulation of each conductor, then the cover is drawn along the cable from the position shown in FIG. 10 and towards the housing 10 so as to be assembled onto the housing for covering the open parts of the passageways. In FIGS. 10 to 13, the terminals 58 and strain relief means 64 are omitted from within passageways 12 for clarity.

Figure 11:
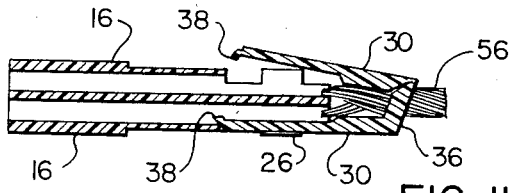

To assemble the cover onto the housing 10, one of the cover portions 30 is first located in position upon its respective side of the housing. In this position, as shown in FIG. 11, the one cover portion is located so as to lie across the open-sided parts of one bank of channels with its projections 38 extending into the closed-sided parts of its passageways and with the apertures 40 receiving the wall extensions 26 on that side of the housing. A slight flexing movement of the cover will assemble the cover portion into this position by firstly locating the projections 38 into the closed-sided parts of the passageways and then urging the apertures over the extensions 26.

Figure 12:
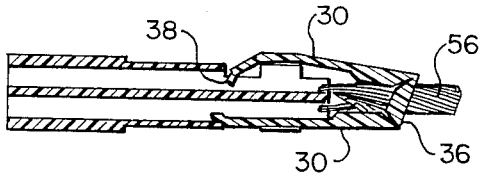
Figure 13:
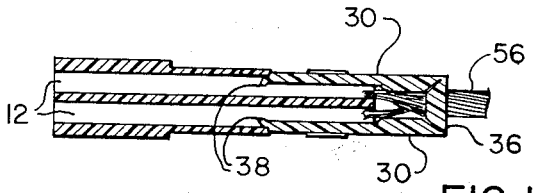
Figure 14:
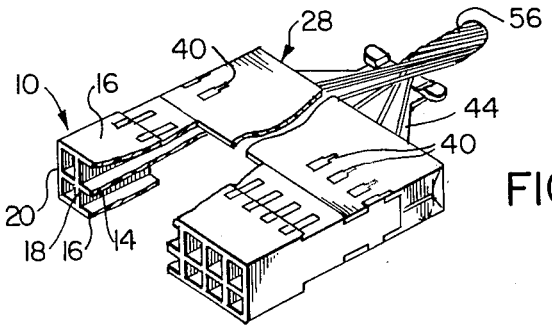
FIG. 14 is an isometric view of the completely assembled connector of the first embodiment.

In this position the spine portion 36 of the cover extends around the remote end of the housing with the cable passing through the opening 42 and the other cover portion lies loosely on the other side of the housing as shown by FIG. 11. To assemble the other cover portion onto the housing, the spine portion is hingedly moved upon the cover portion which is already assembled into position so that it is hinged away from the remote end of the housing, as shown in FIG. 11, thereby drawing the other and unassembled cover portion rearwardly of the housing to position the projections 38 of that cover portion over the open-sided parts of the other bank of passageways. The unassembled cover portion is then flexed as shown in FIG. 12 to position the projections 38 through the open sides of the respective bank of channels. The spine portion is then hingedly moved towards the remote end of the housing as shown by FIG. 13 so as to move the unassembled cover portion forwardly of the housing thereby passing the projections 38 into the closed-sided parts of its respective passageways. During this movement, the downward orientation of the projections 38 provides a camming action upon the respective wall 16 of the housing thereby drawing the free edge of the other cover portion downwardly into close contact with the housing. As forward movement of this cover portion proceeds, it is returned towards its unflexed state, the apertures 40 moving forwardly into alignment with the wall extensions on that side of the housing, to permit the cover portion to be urged downwardly so as to position the apertures around and receive the extensions 26. In the finished assembly as shown in FIGS. 13 and 14, both of the cover portions lie in substantially planar conditions and are securely held to the two sides of the housing so as to complete the assembled connector.

It has been found that the cover described above provides a particularly rigid mounting which is easily assembled onto its housing and yet is resistant to conscious removal thereby rendering inadvertent removal substantially impossible. In fact, it has been found that the cover construction will frustrate any manual attempt to remove it without the assistance of some appropriate tool. One simple and quick method of removing the cover is to insert a thin blade under one of the cover portions 30 from a side edge 48 to one side or the other of the extensions 26. The thin blade must then be urged along the tops of the walls between one side of the cover and the housing and a slight twisting action to the blade will effectively raise the apertured part of that cover portion away from the extensions 26 thereby allowing for removal of that cover portion from the housing. The other cover portion is then easily removed by urging the spine portion of the cover laterally of the connector housing, i.e. downwardly in FIG. 13. This action moves the apertures 40 of the other cover portion from their extensions 26 permitting total removal of the cover.

Should it be required to remove the cover completely from the housing and cable for maintenance purposes, the weakened section 54 may be cut with a cutting edge so as to form a slit which separates the one cover portion into two parts. These parts may be flexed apart (as shown in chain-dotted outline in FIG. 8) so as to widen the slit thereby enabling the cable to pass through the widened slit from the opening 42 thus allowing the cover to be removed. The same or a similar cover with the weakened section cut to form a slit may be refitted onto the housing and around the cable by following the reverse procedure. Thus the cable does not require to be disconnected and reconnected to the housing during the complete removal and replacement of covers.

A cover according to the first embodiment has only a single component as distinct from two smaller components used in the prior art constructions. It will be appreciated that such smaller components are more difficult to handle manually and operation of their small latches requires a particular manual dexterity. In addition, because of its design, the cover of the first embodiment may be made by a simple molding operation. Further, the use of the paddle 44 does not significantly increase the difficulty or complexity of molding a single one-piece cover which provides for flexible movement of the cover portions while the paddle remains in its required position of orientation.

Figure 15:
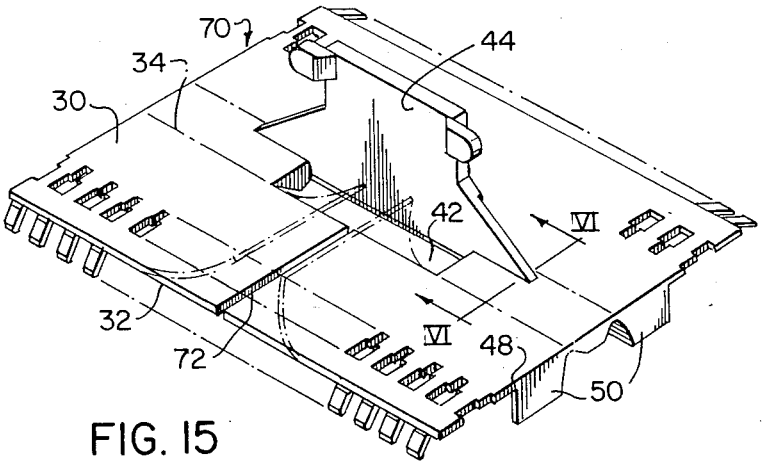
FIG. 15 is a view similar to FIG. 2 of a cover according to a second embodiment.

In a second embodiment shown in FIG. 15, an integral one-piece cover 70 is of similar construction to that described in the first embodiment except that instead of having a weakened section as in the first embodiment, the cover 70 is molded with a slit 72 extending across one cover portion between the opening 42 and its free edge 32 so that this particular cover portion is in fact molded into two parts separated by the slit. As shown in chain-dotted outline in FIG. 15, the two parts of the cover portion may be flexed to widen the slit and accept a cable into opening 42.

The cover 70 may be assembled onto the housing after the cable is connected to the housing. Its method of assembly is substantially the same as that described above with regard to a replacement cover in the first embodiment. The position of the slit 72 is such that the two parts of the cover portion bordering the slit oppose each other along the top of one of the walls 18 of the housing.

Figure 16:
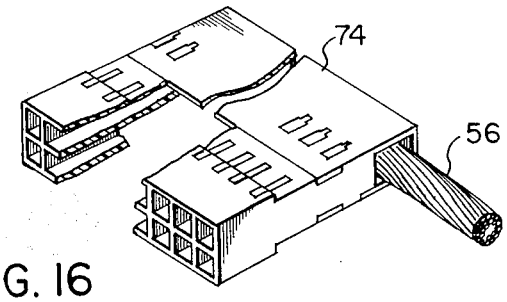
FIG. 16 is a view similar to FIG. 14 of an assembled connector according to a third embodiment.

In a third embodiment, a cover for a connector housing is of similar construction to that described in the first embodiment except that the cover of the third embodiment is not provided with an opening 42 for acceptance of cable. Instead, as shown by FIG. 16, the cover 74 is formed with its flanges 50 and 52 at one side edge 48 of the cover removed or substantially removed to form an opening for passage of the cable 56 laterally of the connector. Thus with the cover 74 mounted in position upon the housing 10, the opening faces in a direction parallel to the hinged edges of the cover portions with the cable projecting laterally. With this construction, the conductors of the cable are assembled into the housing terminals before the cover is assembled onto the housing.

What is claimed is:

1. An integral one-piece cover of insulating material for covering open sides of open-sided parts of two banks of passageways on opposite sides of an electrical connector housing, the open sides facing in opposite directions from one bank to the other, the cover comprising two generally planar cover portions for closing the open sides of the open-sided parts of the passageways, the cover portions hingedly movable towards and away from one another along a hinged edge of each cover portion with each cover portion extending from its hinged edge to a free edge, the hinging movement being into and out of positions in which the cover portions face one another, and in which:

each cover portion is resiliently flexible, is formed along its free edge with spaced apart projections for engagement with closed-sided parts of the passageways of the housing, and between its edges is formed with apertures spaced apart in a direction parallel to its edges for receiving extensions of passageway defining walls of the housing; and with the cover portions facing one another, the cover provides an opening for passage of a cable between the cover portions.

2. A cover according to claim 1 provided with a spine portion which is disposed intermediate the two cover portions with the spine portion having two remote edges to which the hinged edges of the cover portions are hingedly connected.

3. A cover according to claim 2 wherein the opening for passage of the cable is defined through the spine portion and one of the cover portions is provided with a weakened section extending from the opening to its free edge to enable said one cover portion be separated along said weakened section to form a slit and two parts of the cover portion separated by the slit which may be widened by resilient flexing of said two parts to accept a cable and allow it to be positioned through the opening.

4. A cover according to claim 2 having the opening for passage of the cable defined through the spine portion and one of the cover portions is provided with a slit extending from the opening to its free edge to form the one cover portion into two parts separated by the slit which may be widened by resilient flexing of the parts of said one cover portion flanking the slit to accept a cable and allow it to be positioned through the opening.

5. A cover according to claim 1 wherein with the cover portions facing one another, said opening is formed in the vicinity of the hinged edges between side edges of the cover portions which extend between the free and hinged edges so that the opening faces in a direction parallel to the hinged edges.

6. A cover according to claim 1 wherein the projections of each cover portion are oriented so as to be inclined from their free edge towards the projections of the other cover portion when the cover portions face one another.

7. A cover according to claim 2 wherein the projections of each cover portion are oriented so as to be inclined from their free edge towards the projections of the other cover portion when the cover portions face one another.

8. A cover according to claim 3 wherein the projections of each cover portion are oriented so as to be inclined from their free edge towards the projections of the other cover portion when the cover portions face one another.

9. A cover according to claim 1 wherein the cover portions are directly hingedly connected together at their hinged edges and the cover portions are also flexible towards their hinged edges.

10. An electrical connector comprising a housing and a cover of insulating material in which:

the housing is formed with two planar banks of passageways on two opposite sides of the housing, the passageways extending from a mating end face to a remote end of the housing and formed with open-sided parts of the passageways which extend from the remote end of the housing, the open sides of the open-sided parts of the passageways facing in opposite directions from the housing from one bank to the other, the passageways also formed with closed-sided parts extending from the open-sided parts to the mating end face of the housing;

the housing has walls separating the passageways of each bank with the walls of the banks of passageways having localized extensions which are spaced both from the closed-sided parts of the passageways and from the remote end of the housing to locally increase the height of the walls along the open-sided channel parts; and the cover is an integral one-piece structure with two generally planar cover portions hingedly movable towards and away from one another along a hinged edge of each cover portion with each cover portion extending from its hinged edge to a free edge, the hinging movement being into and out of positions in which the cover portions face one another, and in which:

each cover portion is resiliently flexible, is formed along its free edge with spaced apart projections for engagement within closed-sided parts of the passageways of the housing and between its edges is formed with apertures spaced apart in a direction parallel to its edges for receiving the localized extensions of the walls of the housing; and with the cover portions facing one another, the cover provides an opening for passage of a cable between the cover portions;

the cover mountable upon the housing by covering the open sides of one bank of passageways with one cover portion, the projections of which are located within the closed-sided parts of the passageways of said one bank, and the apertures of which receive the localized extensions of the walls of said one bank of passageways, and with the cover extending around the remote end of the housing, hingedly moving the other cover portion towards the open sides of the other bank of passageways while resiliently flexing the other cover portion to position its projections into the open sides of the passageways, and then causing the other cover portion to return to its unflexed state while sliding its projections into the associated closed-sided parts of the passageways and moving its apertures around the extensions on the associated walls of the other bank of passageways.

11. A connector according to claim 10 wherein the cover is provided with a spine portion disposed intermediate the two cover portions with the spine portion having two remote edges to which the hinged edges of the cover portions are hingedly connected, the spine portion located outwardly of the remote end of the housing and away from the mating end face with the cover mounted upon the housing.

12. A connector according to claim 11 wherein the cover is mountable upon the housing with the one cover portion mounted upon the housing and with the spine portion hingedly positioned upon said one cover portion away from the remote end of the housing to move the other cover portion rearwardly in the direction of said remote end, by flexing the other cover portion to position its projections within the open-sided parts of the corresponding bank of passageways, the spine part then being hingedly movable towards the remote end of the housing to move the other cover portion forwardly while moving its projections along the passageways and into the closed-sided parts of the passageways and its apertures around the corresponding wall extensions during release of the other cover portion from its flexed condition.

13. A connector according to claim 12 wherein the opening for passage of the cable is defined through the spine portion and one of the cover portions is provided with a weakened section extending from the opening to its free edge to enable said one cover portion to be separated along said weakened section to form a slit and two parts of the cover portion separated by the slit which may be widened by resilient flexing of said two parts to accept a cable and position it through the opening.

14. A connector according to claim 12 wherein the opening for passage of the cable is defined through the spine portion and one of the cover portions is provided with a slit extending from the opening to the free edge of the cover portion to form said cover portion into two parts separated by the slit which may be widened by resilient flexing of the parts flanking the slit to accept a cable and allow it to be positioned through the opening.

15. A connector according to claim 10 wherein, with the cover portions facing one another, said opening is formed in the vicinity of the hinged edges between side edges of the cover portions, these said edges extending between the free and hinged edges so that said opening faces in a direction parallel to the hinged edges.

16. A connector according to claim 10 wherein the projections of each cover portion are oriented so as to be inclined from its free edge towards the projections on the other cover portion when the cover is mounted upon the housing so as to assist in locating the projections into the closed-sided channel parts.

17. A connector according to claim 11 wherein the projections of each cover portion are oriented so as to be inclined from its free edge towards the projections on the other cover portion when the cover is mounted upon the housing so as to assist in locating the projections into the closed-sided channel parts.

18. A method of securing a cover onto an electrical connector housing comprising:

providing an integral one-piece cover comprising two generally planar and resiliently flexible cover portions hingedly movable towards and away from one another along a hinged edge of each cover portion with each cover portion extending from its hinged edge to a free edge;

locating one cover portion in position to close the open sides of open-sided parts of passageways of one of two planar banks of passageways which extend along opposite sides of the housing from a mating end face to a remote end of the housing with the open-sided parts of the passageways disposed towards the remote end and closed-sided parts of the passageways disposed towards the mating end face of the housing, the one cover portion located in position with projections formed along the free edge of the cover portion extending into the closed-sided parts of the passageways of said one bank and apertures formed in the one cover portion disposed around projections of passageway defining walls of the housing; and then, with the cover extending around the remote end of the housing and with the other cover portion facing the open sides of the other planar bank of passageways, locating the other cover portion in position to close the open sides of the open-sided parts of the passageways of the other bank by:

(a) resiliently flexing the other cover portion to dispose projections along its free edge through the open sides of said other bank of passageways; and then (b) returning the other cover portion towards its unflexed state while sliding its projections into the corresponding closed-sided parts of the passageways and simultaneously moving a flexed apertured region of the other cover portion towards the associated open-sided parts of the passageways to dispose apertures in said region around extensions of passageway defining walls of the housing.

19. A method according to claim 18 wherein resilient flexing of said other cover portion is accompanied by hingedly positioning a spine portion of the cover which lies intermediate the cover portions, away from the remote end of the housing to locate the hinged edge of the other cover portion away from the remote end of the housing; and returning the other cover portion to its unflexed state while moving its hinged edge to a forward position towards the remote end of the housing by hingedly moving the spine portion towards the remote end of the housing.

* * * * *